US008009834B2

(12) United States Patent
Ko

(10) Patent No.: US 8,009,834 B2
(45) Date of Patent: Aug. 30, 2011

(54) SOUND REPRODUCTION APPARATUS AND METHOD OF ENHANCING LOW FREQUENCY COMPONENT

(75) Inventor: Byeong-seob Ko, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1406 days.

(21) Appl. No.: 11/507,488

(22) Filed: Aug. 22, 2006

(65) Prior Publication Data

US 2007/0058816 A1 Mar. 15, 2007

(30) Foreign Application Priority Data

Sep. 9, 2005 (KR) ..... 10-2005-0084239

(51) Int. Cl.
*H04R 5/00* (2006.01)

(52) U.S. Cl. ..... 381/1; 381/61

(58) Field of Classification Search ..... 381/1, 17–23, 381/74, 300, 302, 303, 307, 63, 66
See application file for complete search history.

(56) References Cited

U.S. PATENT DOCUMENTS 2,920,138 A 1/1960 Fogel
3,970,787 A * 7/1976 Searle ..... 381/310
5,123,050 A 6/1992 Serikawa et al.
5,371,799 A 12/1994 Lowe et al.
5,740,253 A * 4/1998 Takeuchi ..... 381/1
5,999,630 A * 12/1999 Iwamatsu ..... 381/17
6,108,430 A 8/2000 Kurisu
6,307,941 B1 10/2001 Tanner, Jr. et al.
6,721,426 B1 4/2004 Kurisu et al.

FOREIGN PATENT DOCUMENTS

| | | |
|---|---|---|
| DE | 41 02 078 | 7/1991 |
| JP | 63-202200 | 8/1988 |
| JP | 2001-189999 | 7/2001 |
| KR | 1997-58321 | 7/1997 |
| KR | 2003-0076332 | 9/2003 |

OTHER PUBLICATIONS

Dutch Search Report dated Mar. 3, 2008 issued in NL 1032460.
Korean Office Action dated Aug. 18, 2006 issued in KR 2005-84239.

* cited by examiner

*Primary Examiner* — Davetta W Goins
*Assistant Examiner* — Lun-See Lao
(74) *Attorney, Agent, or Firm* — Stanzione & Kim, LLP

(57) ABSTRACT

A sound reproduction apparatus and method enhances a low frequency component in a reproduced sound signal using a reflective sound. The sound reproduction apparatus delays and controls gains of input signals, generates a predetermined number of reflective sound signals to enhance a low frequency component, and outputs a sum of reflective sound signals with the enhanced low frequency component.

29 Claims, 9 Drawing Sheets

SOUND REPRODUCTION APPARATUS AND METHOD OF ENHANCING LOW FREQUENCY COMPONENT

CROSS-REFERENCE TO RELATED APPLICATIONS

This application claims priority under 35 U.S.C. & 119(a) from Korean Patent Application No. 10-2005-0084239, filed on Sep. 9, 2005, in the Korean Intellectual Property Office, the disclosure of which is incorporated herein in its entirety by reference.

BACKGROUND OF THE INVENTION

1. Field of the Invention

The present general inventive concept relates to a sound reproduction apparatus and method, and more particularly, to a sound reproduction apparatus and method capable of enhancing a low frequency component in a reproduced sound signal using a reflective sound.

2. Description of the Related Art

A small speaker adopted in headphones, earphones, or portable audio devices is restricted in producing a low sound. To overcome this restriction, a sound signal is conventionally reproduced by enhancing or amplifying a signal corresponding to a low frequency component. However, when the signal corresponding to the low frequency component is increased, a level of a low frequency signal is also increased, for example, due to an overflow of the low frequency signal in an equalizer. To prevent the overflow of the low frequency signal, a dynamic range of an input signal must be considerably reduced, which may deteriorate quality of a finally reproduced sound.

U.S. Pat. No. 6,285,767B1 discloses a "low frequency audio enhancement system" that can enhance a low frequency component.

FIG. 1 is a block diagram illustrating a conventional low frequency enhancement system. Referring to FIG. 1, the low frequency enhancement system comprises a composite filter 1707 employing a band pass filter, a peak compressor 2502 that compresses an output peak value of the composite filter 1707, and a punch unit 1720. The conventional low frequency audio enhancement system uses a mental acoustic approach method (psychoacoustic technique), for example, that a person listening to acoustic energy at 50 Hz and 60 Hz mentally perceives acoustic energy at 110 Hz or a person listening to acoustic energy at 100 Hz and 150 Hz mentally perceives acoustic energy at 50 Hz.

An adder 1706 adds two input signals 1702 and 1733. The composite filter 1707 extracts low frequency components from the added signal using filters 1711, 1715, 1712, 1713, and 1714 having frequency bands 50, 250, 100, 150, and 220 Hz, respectively, adds the extracted low frequency components, and outputs the added low frequency components through a switch 1722 and an adder 1718. The peak compressor 2502 prevents an overflow caused by the addition of the extracted low frequency components. In detail, as a plurality of low frequency band pass filters output low frequency component signals, a sum of the low frequency component signals has an increased peak value, which may cause the overflow. If an output signal only is standardized to reduce the peak value, a low frequency enhancement effect is removed. Therefore, even if a non-linearly low level signal increases its level, the increased level remains in a dynamic range of the conventional low frequency enhancement system, thereby maintaining the low frequency enhancement effect. The punch unit 1720 expands a release time of a low frequency component to allow a listener to listen to the low frequency component for more prolonged time, thereby increasing the low frequency enhancement effect. An output of the punch unit 1720 is added to the input signals at adders 1724 and 1732 through a switch 1722 to generate output signals 1730 and 1733.

However, the conventional low frequency audio enhancement system has a complex constitution since an amount of calculation increases due to a large number of low frequency band pass filters, and an additional device, such as the peak compressor 2502 is required to adjust the dynamic range of the conventional low frequency enhancement system. Also, when the punch unit 1720 only enhances the low frequency component, a listener has no externalization when listening to sounds through headphones, etc.

Japanese Patent Publication Application No. Hei 5-328481 discloses a frequency doubling and mixing circuit that enhances a low frequency component by forming a harmonic component of an input signal. The frequency doubling and mixing circuit includes a radio rectifier and a low band filter to generate a low pass filter and the harmonic component. The frequency doubling and mixing circuit obtains a frequency component that requires the formation of the harmonic component using the low pass filter from the input signal, generates the harmonic component that doubles a frequency component using the radio rectifier from the obtained signal at a frequency position higher by one octave, and enhances a mental acoustic of the low frequency component. However, the frequency doubling and mixing circuit uses the radio rectifier to forcibly clip or invert the input signal in order to generate the harmonic component, which may greatly deteriorate the sound quality.

As described above, although these conventional sound reproduction methods enhance a low frequency component such that a user perceives an illusionary low frequency component in terms of mental acoustic to generate a harmonic component, such that the sound quality is deteriorated by clipping an input signal, or the constitution that is complex due to various filtering and additional apparatuses. Also, the low frequency component enhanced by these conventional sound reproduction methods is generally a mono component. Therefore, when a listener listens to a signal having the mono component through headphones, earphones, etc., a higher energy low frequency component is centered in a brain, what is called, brain localization, which causes coercion or fatigue.

SUMMARY OF THE INVENTION

The present general inventive concept provides a sound reproduction apparatus and method capable of enhancing a low frequency component with a small quantity of calculation and a simple constitution.

The present general inventive concept also provides a sound reproduction apparatus and method capable of brain localization by providing an acoustic signal having an enhanced low frequency component with externalization.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing a sound reproduction apparatus comprising a low frequency enhancer to delay and gain-control input signals, to generate a predetermined number of reflective sounds to enhance a low frequency component of the input signals, and to output a sum of signals corresponding to the reflective sounds with the enhanced low frequency component, and an externalization generator to generate first and second output signals with externalization by delaying the sum of signals with the enhanced low frequency component by first and second times.

The apparatus may further comprise first and second gain controllers to gain-control and output first and second input signals, and a first adder to provide the sum of the signals output from the first and second gain controllers as an input signal of the low frequency enhancer.

The apparatus may further comprise a second adder to sum and output the first input signal and the first output signal, and a third adder to sum and output the second input signal and the second output signal.

The foregoing and/or other aspects of the present general inventive concept may be achieved by providing a sound reproduction apparatus comprising a first adder to output a sum of first and second input signals whose gains are controlled, a low frequency enhancer to delay and gain-control the sum signal output from the first adder, to generate a predetermined number of reflective sounds to enhance a low frequency component of thereof, and outputting a sum of signals corresponding to the reflective sounds with the enhanced low frequency component, and second and third adders adding the sum of signals with the enhanced low frequency component to the first and second input signals to generate first and second output signals.

The foregoing and/or other aspects of the present general inventive concept may be achieved by providing a sound reproduction method comprising delaying and gain-controlling input signals, generating a predetermined number of reflective sounds to enhance a low frequency component of the input signals, outputting a sum of signals with the enhanced low frequency component, and delaying the sum of signals with the enhanced low frequency component by first and second times to generate first and second output signals that have externalization.

The foregoing and/or other aspects of the present general inventive concept may be achieved by providing a sound reproduction method comprising outputting a sum of first and second input signals whose gains are controlled, delaying and controlling gain of the sum signal, generating a predetermined number of reflective sounds to enhance a low frequency component thereof, outputting a sum of signals corresponding to the reflective sounds with the enhanced low frequency component, and adding the sum of signals with the enhanced low frequency component to the first and second input signals to generate first and second output signals.

The foregoing and/or other aspects of the present general inventive concept may be achieved by providing a computer readable recording medium having embodied thereon a computer program to execute the above-described sound reproduction method.

The foregoing and/or other aspects of the present general inventive concept may be achieved by providing a sound reproduction apparatus including a low frequency enhancer to delay and gain-control input signals, to generate a sum signal of the delayed and gain-controlled input signals, to generate a plurality of reflective sound signals from the sum signal to enhance a low frequency component thereof, and to output a sum of reflective sound signals with the enhanced low frequency component, and an externalization generator to generate first and second output signals with externalization according to the input signals, the sum of reflective sound signals, and a delay of at least one of the input signals and the sum of reflective sound signals.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
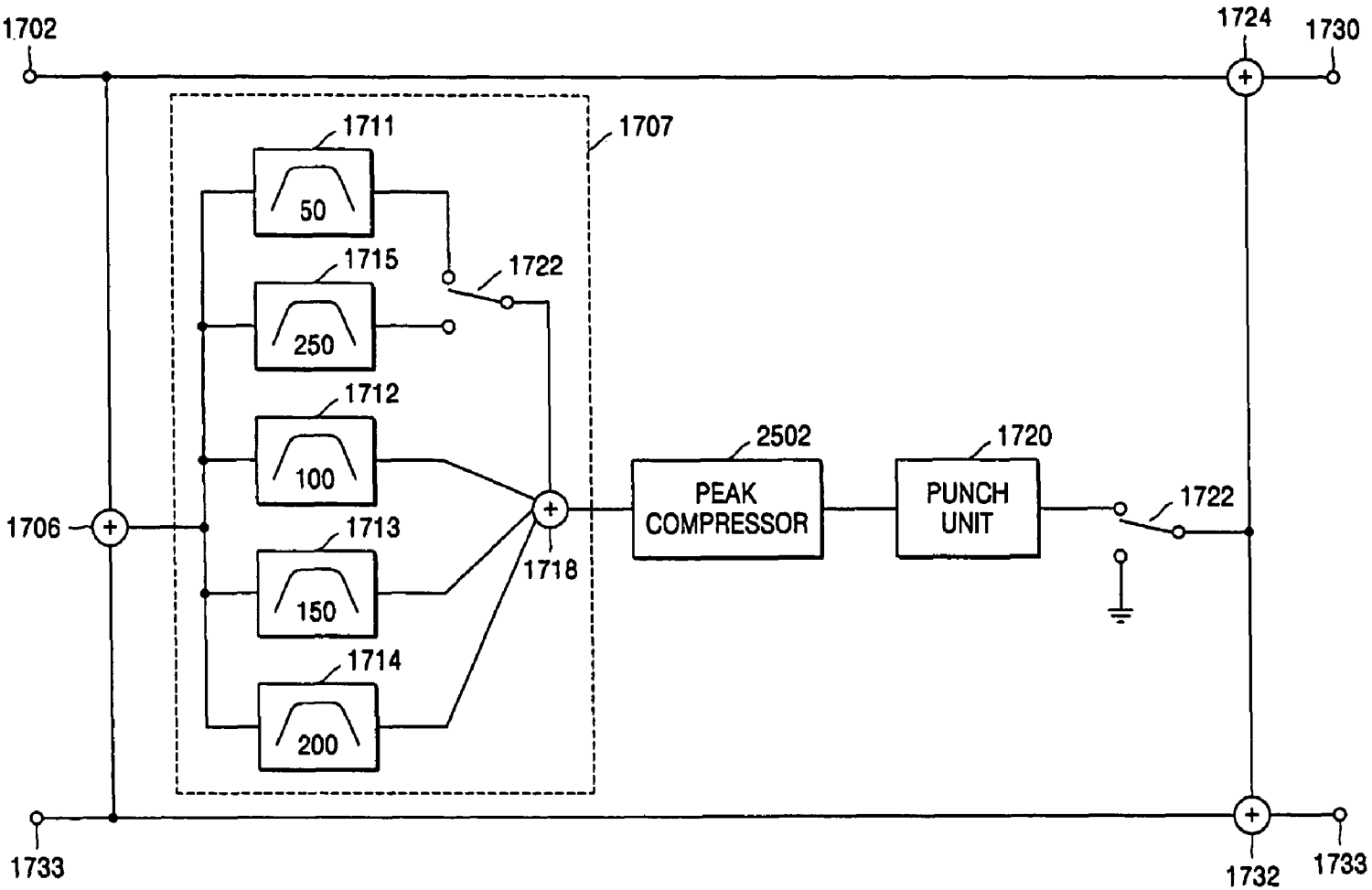
FIG. 1 (PRIOR ART)
FIG. 1 is a block diagram illustrating a conventional low frequency enhancement system.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

The present general inventive concept enhances a low frequency component using a mental acoustic approach that uses a reflective sound based on a space impulse response characteristic. Also, the present general inventive concept can provide the enhanced low frequency component with externalization using an amount of delay based on non-linearity of hearing space and sense.

Figure 2:
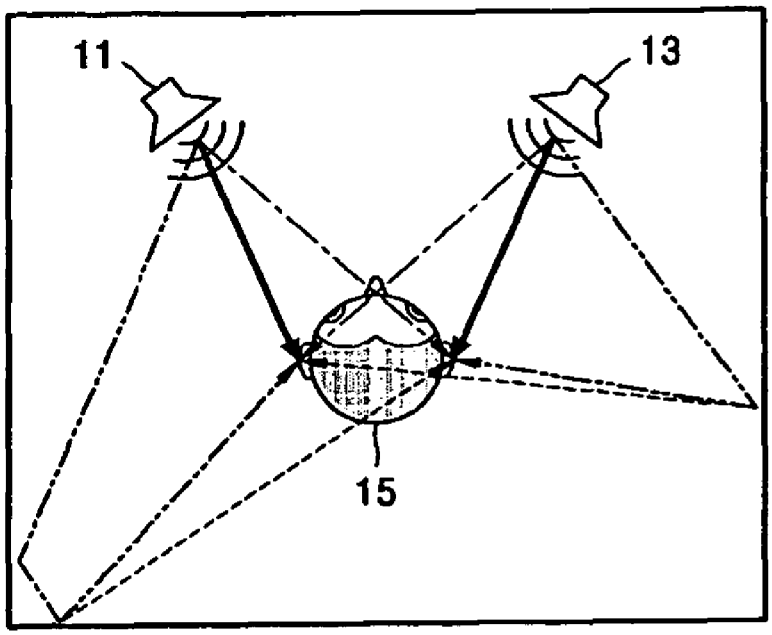
FIG. 2 is a diagram illustrating a sound reflection characteristic in a space.

FIG. 2 is a diagram illustrating a sound reflection characteristic in a space. Referring to FIG. 2, the space includes two sound sources, i.e., speakers 11 and 13, and a listener 15 who listens to sounds reproduced through the speakers 11 and 13. In this case, both ears of the listener 15 hear sounds directly from the speakers 11 and 13 and sounds reflected from a wall of the space as well. A solid line indicates a direct sound and other lines (dotted lines) indicate a reflective sound.

Figure 3:
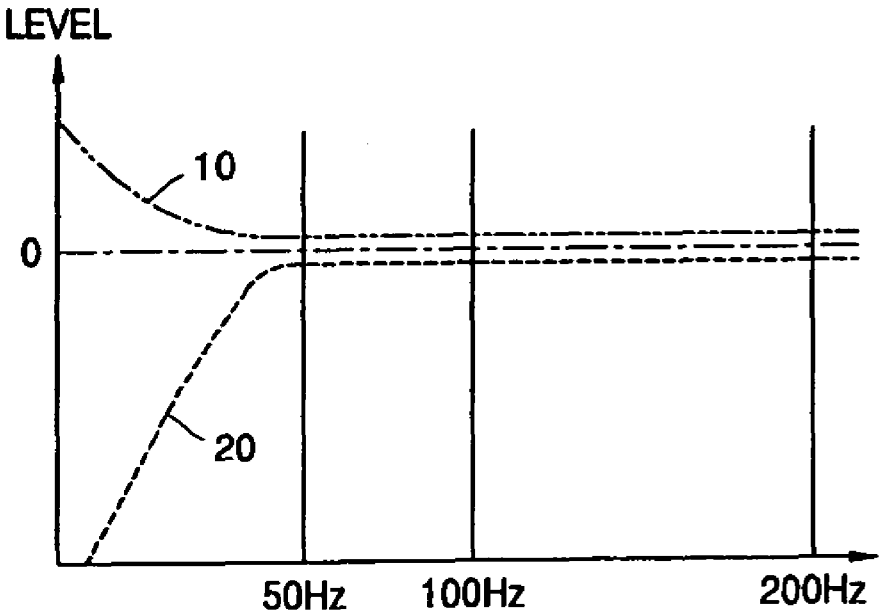
FIG. 3 is a graph illustrating a frequency response characteristic of space and speaker in the space illustrated in FIG. 2.

FIG. 3 is a graph illustrating a frequency response characteristic of a space and a speaker in the space of FIG. 2. Referring to FIG. 3, a curve 20 indicates the response characteristic of the speaker and a curve 10 indicates space amplification according to frequencies when a sound is generated. A low frequency component, for example, a resonance device having a resonance point, is boosted in a very low frequency.

Figure 4:
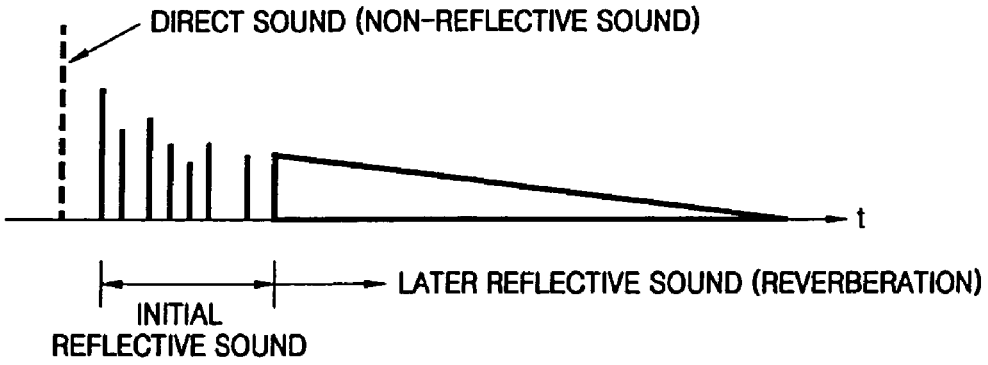
FIG. 4 is a graph illustrating a space impulse response in the space illustrated in FIG. 2.

FIG. 4 is a graph illustrating a space impulse response in the space of FIG. 2. Referring to FIG. 4, the space impulse response having a reflection characteristic in the space includes a direct sound (a non-reflective sound), an initial reflective sound, and a later reflective sound (a reverberation sound). These sounds are determined by their volume when they are generated.

Referring to FIGS. 2 through 4, when a listening space is small and a differential time between sounds reflected from a wall is very small, even if sounds having the same volume are generated, the low frequency component is very greatly amplified. Also, if these reflective sounds have an arriving differential time enough to be perceived as a sound by a human's hearing rather than an independent reflective sound, they are mentally perceived as a large volume of sounds.

Also, a specific frequency component is decreased or amplified due to the arriving differential time between the reflective sounds to enhance the low frequency component. In this regard, a low frequency component is amplified, whereas a middle/high frequency component is decreased, such that a separate filter for filtering the low frequency component only is not required. Also, a delay difference between two signals having the enhanced direct sound and low frequency component is properly adjusted in order to prevent overflow caused by the sum of the two signals. Therefore, a peak compressor for preventing overflow is not required. Finally, since the reflective sounds having the delay difference can control a release time of the low frequency component, a punch unit is not required.

Based on the characteristics, the sound reproduction apparatus according to an embodiment of the present invention can enhance a low frequency component, provide the enhanced low frequency component with externalization, and simplify the constitution without a filter, a peak compressor, and a punch unit used by conventional technologies.

Figure 5:
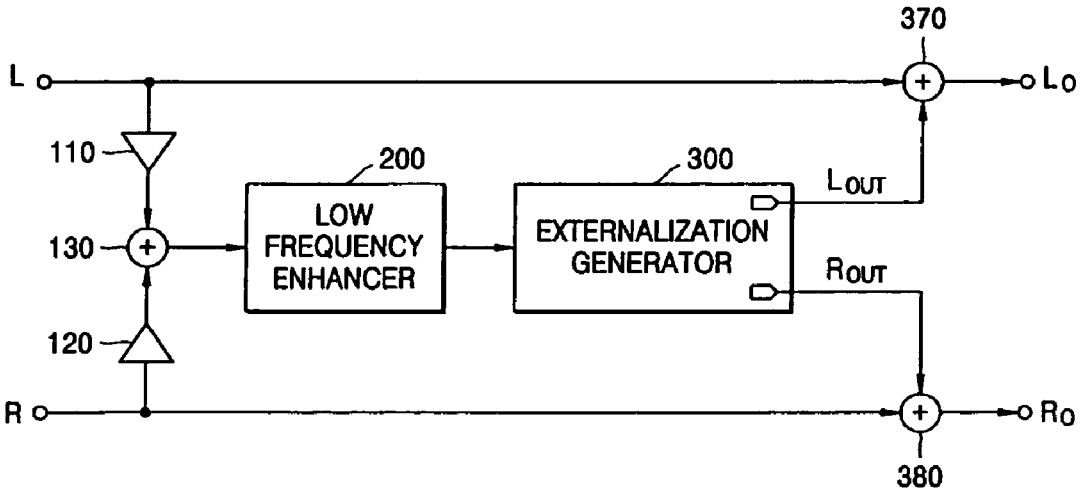
FIG. 5 is a block diagram illustrating a sound reproduction apparatus according an embodiment of the present general inventive concept.

FIG. 5 is a block diagram illustrating a sound reproduction apparatus according an embodiment of the present general inventive concept. Referring to FIG. 5, the sound reproduction apparatus comprises first and second gain controller 110 and 120, a first adder 130, a low frequency enhancer 200, an externalization generator 300, and second and third adders 370 and 380.

The first and second gain controllers 110 and 120 control gains of input signals L and R, for example, signals of let and right channels (left and right channel signals), respectively. The adder 130 adds the input signals L and R whose gains are controlled by the first and second gain controllers 110 and 120 and outputs an added input signal. The first and second gain controllers 110 and 120 control gains of the input signals L and R to allow a sum of the input signals L and R to have a desirable level or a predetermined level.

The low frequency enhancer 200 delays and controls a gain of the added input signal output from the adder 130, generates reflective sounds to enhance a low frequency thereof, and outputs a first added signal.

The externalization generator 300 outputs signals Lout and Rout to allow the first added signal output by the low frequency enhancer 200 to have externalization.

The second adder 370 adds the signal Lout output by the externalization generator 300 to the input signal L and outputs a second added signal as a final left signal Lo. The third adder 380 adds the signal Rout output by the externalization generator 300 to the input signal R and outputs a third added signal as a final right signal Ro.

A listener can listen to the signals Lo and Ro output by the second and third adders 370 and 380 through an earphone, a headphone, etc.

Figure 6A:
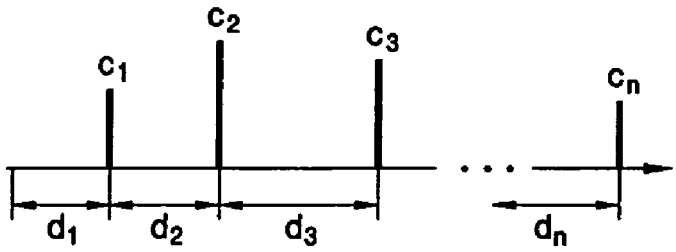
FIGS. 6A and 6B are diagram illustrating a low frequency enhancer of the sound reproduction system of in FIG. 5.
Figure 6B:
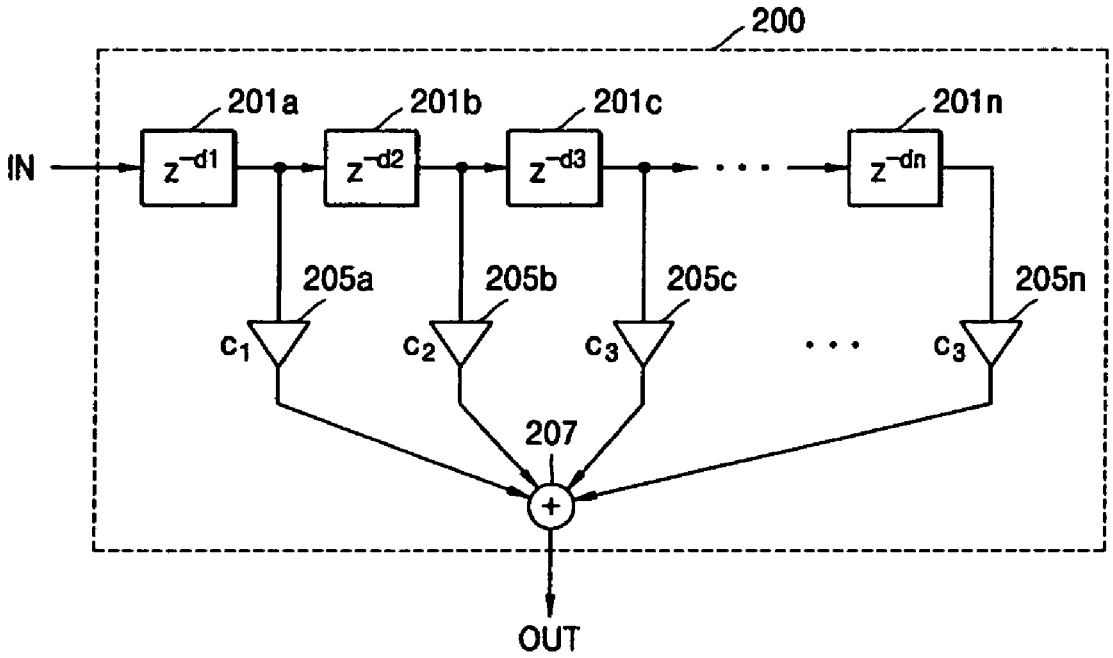

FIG. 6A is a view illustrating a reflective sound pattern to enhance a low frequency. FIG. 6B is a view illustrating the low frequency enhancer 200 of FIG. 5 for the reflective sound pattern to enhance the low frequency (or low frequency component) illustrated in FIG. 6A. Referring to FIGS. 5, 6A, and 6B, the low frequency enhancer 200 comprises first through nth delay 201*a* through 201*n*, first through nth gain controllers 205*a* through 205*n*, and an adder 207.

The first through nth delay 201*a* through 201*n* delay the added input signal input to the low frequency enhancer 200 by each time of d1, d2, . . . , dn, and output the delayed signals.

The first through nth gain controllers 205*a* through 205*n* control corresponding ones of the output signals of the first through nth delay 201*a* through 201*n* according to predetermined gains and output the controlled signals.

The adder 207 adds the controlled signals of the first through nth gain controllers 205*a* through 205*n* and outputs the first added signal.

The delay time of the first through nth delay 201*a* through 201*n* and the gain values of the first through nth gain controllers 205*a* through 205*n* are determined by the reflective sound pattern to enhance the low frequency. The reflective sound pattern to enhance the low frequency can be calculated by a test or experiment. If the delay time of the first through nth delay 201*a* through 201*n* and the gain values of the first through nth gain controllers 205*a* through 205*n* are controlled to satisfy the reflective sound pattern to enhance the low frequency, the output signal of the low frequency enhancer 200 is identical to a sum of reflective sounds for enhancing the low frequency.

Therefore, the low frequency enhancer 200 performs functions of a filter, a peak compressor, and a punch unit that are usually used to enhance the low frequency. A more detailed description to the low frequency enhancer 200 will now be provided with reference to FIGS. 7 and 8.

Figure 7:
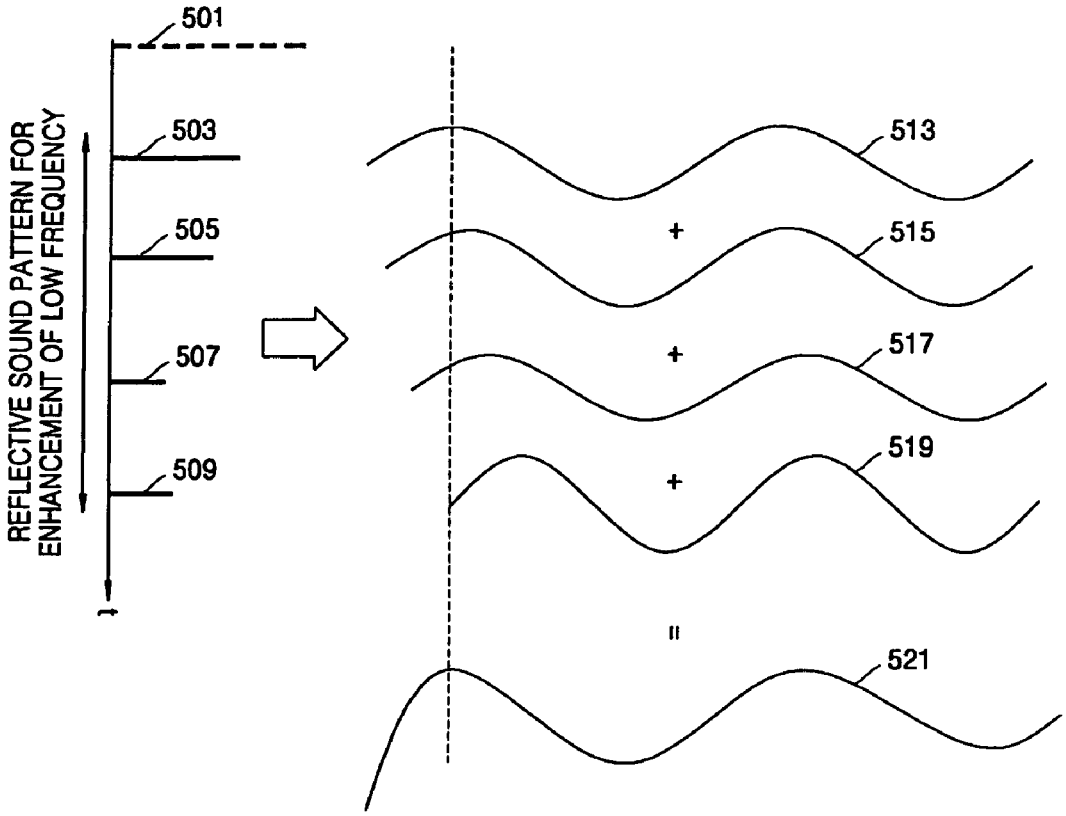
FIG. 7 is a view illustrating waveforms of low frequency components corresponding to a reflective sound pattern for enhancement of a low frequency in the sound reproduction system of FIG. 5.

FIG. 7 exemplarily is a view illustrating waveforms of low frequency components corresponding to reflective sound patterns for the enhancement of the low frequency in the sound reproduction system of FIG. 5. Referring to FIG. 7, a direct sound 501, waveforms 513, 515, 517, and 519 of low frequency components corresponding to reflective sound patterns 503, 505, 507, and 509 to enhance the low frequency, and a waveform 521 that is a sum of the waveforms 513, 515, 517, and 519 are illustrated.

Figure 8:
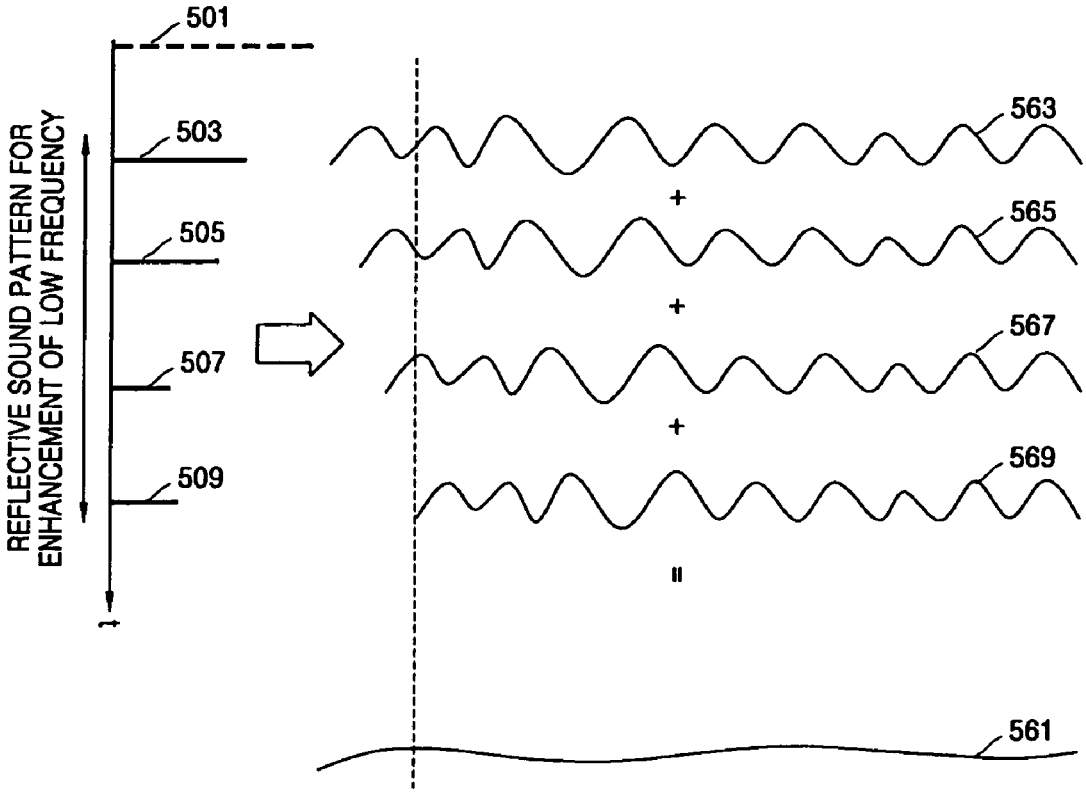
FIG. 8 is a view illustrating waveforms of high frequency components corresponding to a reflective sound pattern for enhancement of a low frequency in the sound reproduction system of FIG. 5.

FIG. 8 is a view illustrating waveforms of high frequency components corresponding to reflective sound patterns for the enhancement of the low frequency in the sound reproduction system of FIG. 5. Referring to FIG. 8, a direct sound 501, waveforms 563, 565, 567, and 569 of high frequency components corresponding to the reflective sound patterns 503, 505, 507, and 509 to enhance the low frequency, and a waveform 521 that is a sum of the waveforms 563, 565, 567, and 569 are illustrated.

As mentioned above, a specific frequency component is decreased or amplified due to an arriving differential time between the reflective sounds for enhancing the low frequency component. In this regard, a low frequency component is amplified, whereas a middle/high frequency component is decreased. In detail, the low frequency components are amplified by extending a release time due to a delay difference between reflective sounds as illustrated in FIG. 7, and middle/high frequency components are decreased as illustrated in FIG. 8. That is because a wavelength of a middle/high frequency component is much shorter than that of a low frequency component.

The low frequency enhancer 200 can perform the functions of the filter to filter a low frequency component and the punch unit to enhance a designated frequency component. When a delay difference between the direct sound 501 and a signal obtained from the above processes is properly controlled, the peak compressor is not required by making a high level peak value and an adding synchronization different.

Figure 9A:
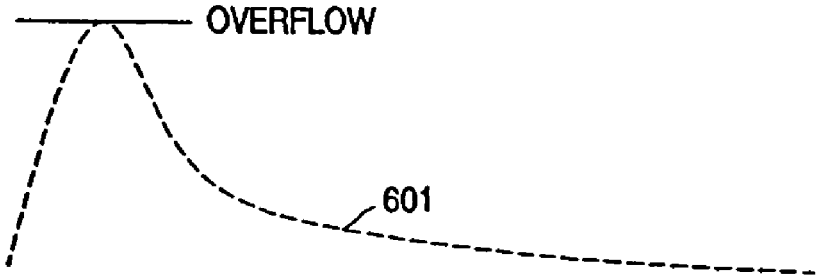
FIGS. 9A, 9B, and 9C are diagrams illustrating patterns of signals output from the sound reproduction apparatus of FIG. 5.
Figure 9B:
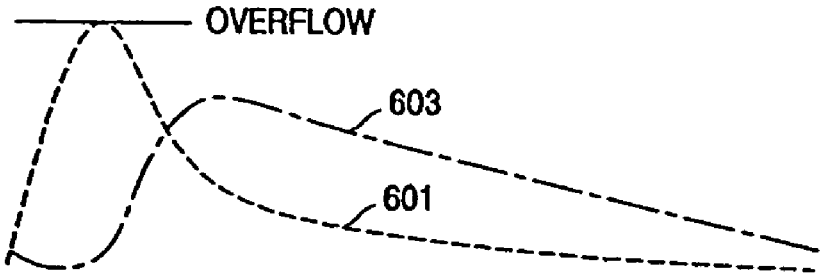
Figure 9C:
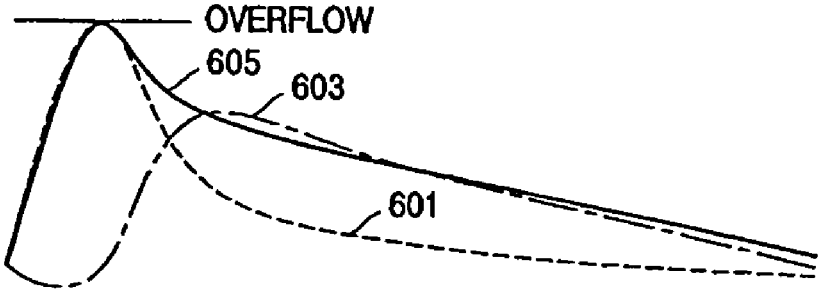

FIGS. 9A, 9B, and 9C are diagrams illustrating patterns of signals output from the sound reproduction apparatus of FIG. 5. FIG. 9A illustrates a waveform 601 of a direct sound without being reflected, which is an input signal. FIG. 9B illustrates the waveform 601 of the direct sound and a waveform 603 of an output sound from the low frequency enhancer 200 according to the reflective sound pattern for the enhancement of the low frequency. FIG. 9C illustrates a waveform 605 of a final output sound that is the sum of the direct sound and the output sound. Referring to FIGS. 9A, 9B, and 9C, the sound reproduction apparatus according to an embodiment of the present general inventive concept can obtain an output sound with an enhanced low frequency.

Meanwhile, a reflective sound pattern is used and low frequency components corresponding to left/right channels are enhanced using two different patterns for the left/right channels, thereby preventing a sound image from localizing in a brain by enhancing a monaural low frequency component, i.e., brain localization. That is, the low frequency enhancer 200 outputs a stereo sound. However, the brain localization of the sound image may not be completely prevented, and adversely an amount of calculation may increase. Therefore, to positively prevent the brain localization of the sound image, the externalization generator 300 must be applied as illustrated in FIGS. 10 and 11.

Figure 10:
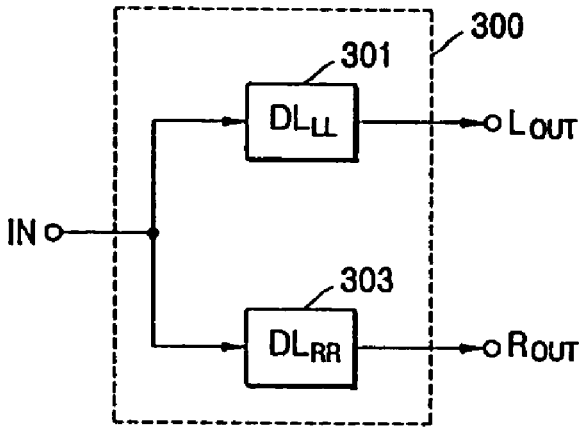
FIG. 10 is a view illustrating an externalization generator based on a left/right delay difference in an externalization generator 300 of the sound reproduction apparatus of FIG. 5.

Referring to FIG. 10, the externalization generator 300 uses two delay elements DLL 301 and DLRR 303 that have different delay times of input signals to have a differential time between low frequency components of left/right output signals, thereby easily preventing the brain localization and providing the externalization.

Figure 11:
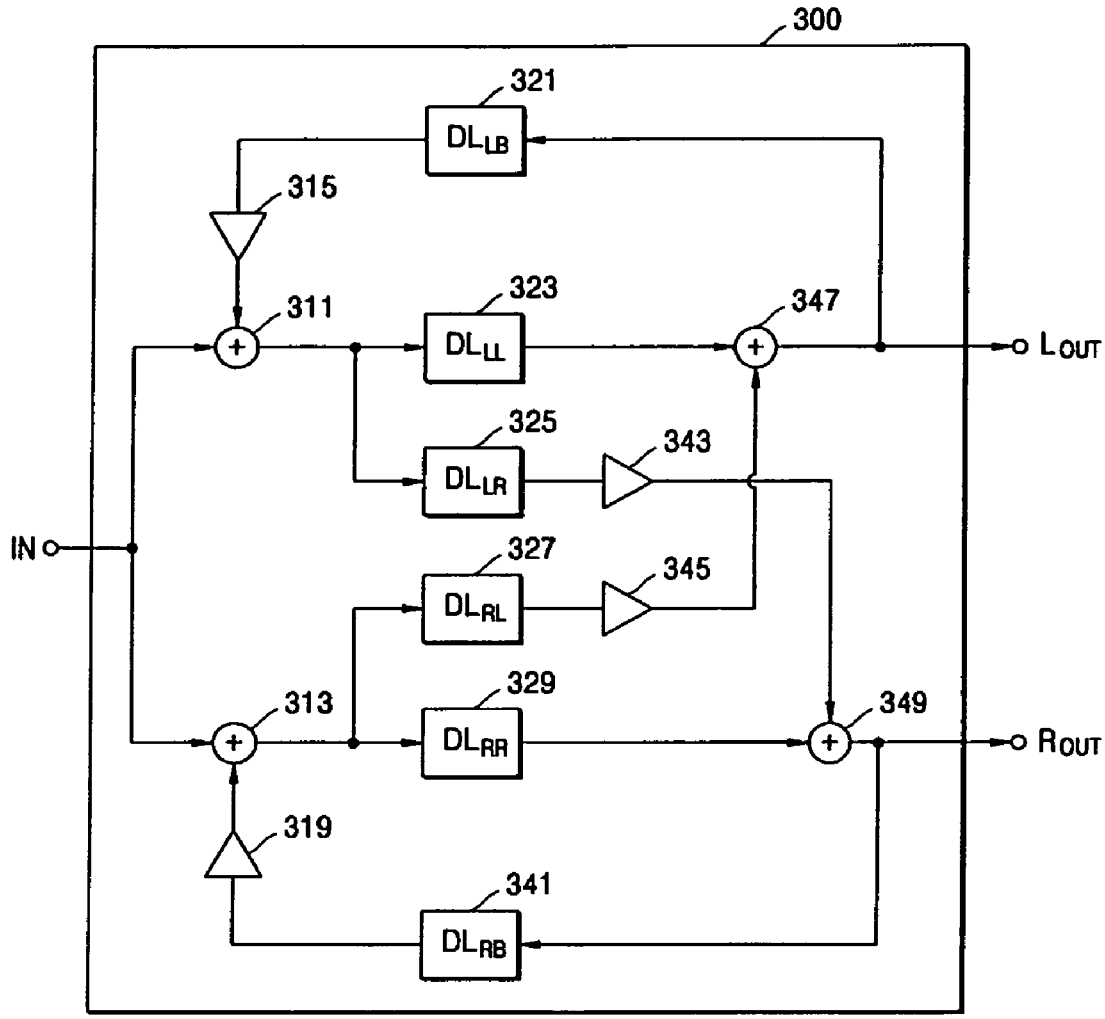
FIG. 11 is a view illustrating a non-linear externalization generator.

Referring to FIG. 11, the externalization generator 300 of FIG. 11 is an extension of the externalization generator 300 of FIG. 10 and provides the externalization according to non-linearity of a listening space, i.e., physical non-linearity of a listener's left/right ears and sound sources, non-linearity of a reflective route of a sound in a space, or non-linearity of a human's hearing. The externalization generator 300 of FIG. 11 includes delay buffers 321, 323, 325, 327, 329, and 341, adders 311, 313, 347, and 349, and gain controllers 315, 319, 343, and 345, and determines two virtual sound sources and a virtual listener, delays a signal input to the externalization generator 300 by a first time corresponding to a first virtual sound source and a virtual listener's left ear, generates a first output signal, delays the input signal by a second time corresponding to the second virtual sound source and a virtual listener's right ear, and provides the externalization.

The above constitution and function are described in Korean Patent Application No. 10-2004-0097019 entitled with "apparatus and method for generating a virtual stereo sound using non-linearity and a computer readable medium therefore" that was filed in the name of the same applicant.

Figure 12:
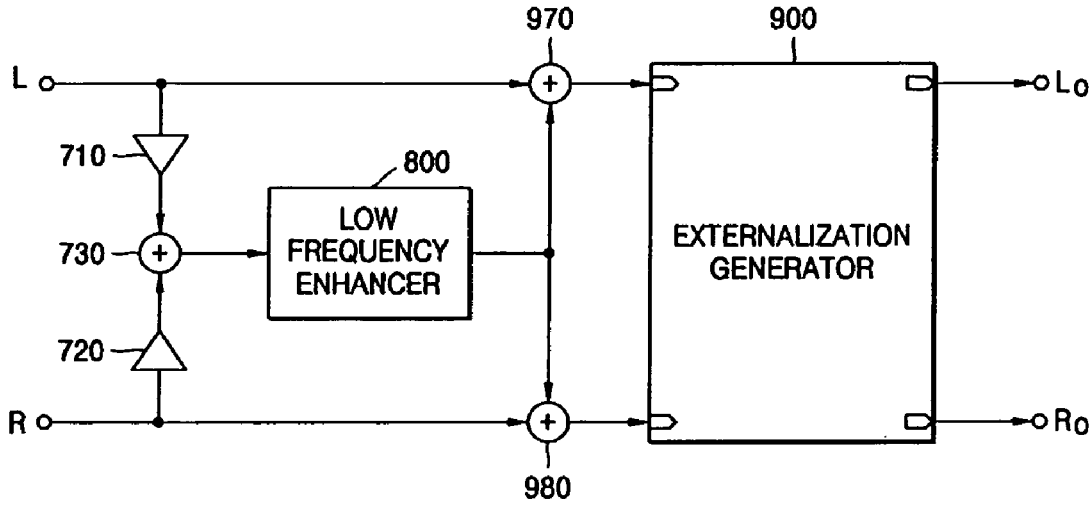
FIG. 12 is a block diagram illustrating a sound processor according to another embodiment of the present general inventive concept.

FIG. 12 is a block diagram illustrating a sound processor according to another embodiment of the present general inventive concept. Referring to FIG. 12, the sound processor does not apply externalization to a signal with an enhanced low frequency but to an input signal to which the signal with an enhanced low frequency is added, which is different from a previous embodiment.

In detail, first and second gain controllers 710 and 720, a first adder 730, and a low frequency enhancer 800 of the sound processor of FIG. 12 are similar to those of the sound reproduction apparatus illustrated in FIG. 5. However, an externalization generator 900 of the sound processor can further perform two auxiliary functions. That is, the externalization generator 900 forcibly reduces a peak value of a low frequency component and adversely amplifies the low frequency component.

Referring to FIG. 11, in order to reduce the peak value of the low frequency component, a value of a gain controller is changed to minus and an amount of delay is controlled to control gains of output ends of the delay buffers $DL_{LR}$ 325 and $DL_{RL}$ 327, by which output of the delay buffers $DL_{LR}$ 325 and $DL_{RL}$ 327 are added to a specific frequency in a manner of reverse phase, thereby reducing a peak value of a final output signal. Likewise, the output of the delay buffers $DL_{LR}$ 325 and $DL_{RL}$ 327 are added to a specific frequency in a manner of in phase, thereby amplifying the low frequency. Therefore, the externalization generator 900 can forcibly reduce the peak value of the low frequency component and amplify the low frequency component, if necessary.

The present general inventive concept can also be embodied as computer readable code on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves. The computer readable recording medium can also be distributed network coupled computer systems so that the computer readable code is stored and executed in a distributed fashion.

As described above, the present general inventive concept uses a reflective sound generated according to a reflective sound pattern to enhance a low frequency to maintain a dynamic range of a sound source with a small amount of calculation and enhance a low frequency component of a reproduced sound signal. Therefore, the present general inventive concept can reproduce a sufficient low sound through a small speaker of a portable audio, a headphone, or an earphone. Also, the present general inventive concept can provide the enhanced low frequency component with externalization, so that, when a listener listens to sound through the headphone, brain localization of a high energetic sound image of the low frequency component can be prevented, which increases user's satisfaction.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A sound reproduction apparatus comprising:

a low frequency enhancer to delay and gain-control an input signal, to generate a predetermined number of reflective sounds from the delayed and gain-controlled input signal to enhance a low frequency component thereof, and output a sum of signals corresponding to the reflective sounds with the enhanced low frequency component; and an externalization generator to generate first and second output signals with externalization by delaying the sum of the signals with the enhanced low frequency component by first and second times, wherein the predetermined number of reflective sounds are generated according to a reflective sound pattern to enhance the low frequency component.

2. The apparatus of claim 1, further comprising:

first and second gain controllers to gain-control and output first and second input signals; and a first adder to provide a sum of the gain-controlled signals output from the first and second gain controllers as an input signal of the low frequency enhancer.

3. The apparatus of claim 2, further comprising:

a second adder to sum and add the first input signal and the first output signal; and a third adder to sum and output the second input signal and the second output signal.

4. The apparatus of claim 1, wherein the low frequency enhancer generates the reflective sounds by delaying and gain-controlling the delayed and gain-controlled input signal according to a delay time and a gain value determined based on a reflective sound pattern to enhance the low frequency component.

5. The apparatus of claim 1, wherein:

the first time is a first delay time corresponding to a first distance between a first virtual sound source and a virtual listener's left ear; and the second time is a second delay time corresponding to a second distance between a second virtual sound source and a virtual listener's right ear.

6. A sound reproduction apparatus comprising:

a first adder to output a sum of first and second input signals whose gains are controlled;

a low frequency enhancer to delay and gain-control the sum signal output from the first adder, to generate a predetermined number of reflective sounds to enhance a low frequency component of the first and second input signals, and to output sum of signals corresponding to the reflective sounds with the enhanced low frequency component; and second and third adders to add the sum of signals with the enhanced low frequency component to the first and second input signals to generate first and second output signals, wherein the predetermined number of reflective sounds are generated according to a reflective sound pattern to enhance the low frequency component.

7. The apparatus of claim 6, further comprising:

an externalization generator to delay the first and second output signals output from the second and third adders by first and second times and to output the delayed signals that have externalization.

8. The apparatus of claim 7, wherein:

the first time is a first delay time corresponding to a first distance between a first virtual sound source and a virtual listener's left ear; and the second time is a second delay time corresponding to a second distance between a second virtual sound source and a virtual listener's right ear.

9. The apparatus of claim 6, further comprising:

first and second gain controllers to control gains of the first and second input signals and to provide the adders with the gain-controlled first and second signals.

10. The apparatus of claim 6, wherein the low frequency enhancer generates the reflective sounds by delaying and gain-controlling the sum signal output from the first adder according to a delay time and a gain value determined based on a reflective sound pattern to enhance the low frequency component.

11. A sound reproduction method comprising:

delaying and gain-controlling input signals, and generating a predetermined number of reflective sounds to enhance a low frequency component;

outputting a sum of signals corresponding to the reflective sounds with the enhanced low frequency component; and delaying the sum of signals with the enhanced low frequency component by first and second times to generate first and second output signals that have externalization, wherein the predetermined number of reflective sounds are generated according to a reflective sound pattern to enhance the low frequency component.

12. The method of claim 11, wherein:

the first time is a first delay time corresponding to a first distance between a first virtual sound source and a virtual listener's left ear; and the second time is a second delay time corresponding to a second distance between a second virtual sound source and a virtual listener's right ear.

13. The method of claim 11, further comprising:

controlling gains of first and second input signals to provide a sum of the gain-controlled first and second signals as the input signals.

14. The method of claim 13, further comprising:

summing and outputting the first input signal and the first output signal, and summing and outputting the second input signal and the second output signal.

15. The method of claim 11, wherein the generating of the reflective sounds comprises generating the reflective sounds by delaying and controlling a gain of the delayed and gain-controlled input signals according to a delay time and a gain values determined based on a reflective sound pattern to enhance the low frequency component.

16. A sound reproduction method comprising:

outputting a sum of first and second input signals whose gains are controlled;

delaying and controlling gain of the sum signal and generating a predetermined number of reflective sounds to enhance a low frequency component;

outputting a sum of signals corresponding to the reflective sounds as the enhanced low frequency component; and adding the enhanced low frequency component to the first and second input signals to generate first and second output signals, wherein the predetermined number of reflective sounds are generated according to a reflective sound pattern to enhance the low frequency component.

17. The method of claim 16, further comprising:

delaying the first and second output signals by the first and second time to provide the first and second output signals with externalization.

18. The method of claim 17, wherein:

the first time is a first delay time corresponding to a first distance between a first virtual sound source and a virtual listener's left ear; and the second time is a second delay time corresponding to a second distance between a second virtual sound source and a virtual listener's right ear.

19. The method of claim 16, wherein the generating of the reflective sounds comprises generating the reflective sounds by delaying and gain-controlling the sum of the signals according to delay times and gain values determined based on a reflective sound pattern to enhance the low frequency component.

20. A non-transitory computer readable recording medium having embodied thereon a computer program for executing a sound reproduction method, the method comprising:

delaying and gain-controlling input signals and generating a predetermined number of reflective sounds to enhance a low frequency component;

outputting a sum of signals corresponding to the reflective sounds with the enhanced low frequency component; and delaying the sum of signals with the enhanced low frequency component by first and second times and generating first and second output signals that have externalization, wherein the predetermined number of reflective sounds are generated according to a reflective sound pattern to enhance the low frequency component.

21. A non-transitory computer readable recording medium having embodied thereon a computer program for executing a sound reproduction method, the method comprising:

outputting a sum of first and second input signals whose gains are controlled;

delaying and gain-controlling gain of the sum signal, and generating a predetermined number of reflective sounds to enhance a low frequency component;

outputting a sum of signals corresponding to the reflective sounds with the enhanced low frequency component; and adding the sum of signals with the enhanced low frequency component to the first and second input signals and generating first and second output signals, wherein the predetermined number of reflective sounds are generated according to a reflective sound pattern to enhance the low frequency component.

22. A sound reproduction apparatus comprising:

a low frequency enhancer to delay and gain-control input signals, to generate a sum signal of the delayed and gain-controlled input signals, to generate a plurality of reflective sound signals from the sum signal to enhance a low frequency component thereof, and to output a sum of reflective sound signals with the enhanced low frequency component; and an externalization generator to generate first and second output signals with externalization according to the input signals, the sum of reflective sound signals, and a delay of at least one of the input signals and the sum of reflective sound signals, wherein the number of reflective sound signals are generated according to a reflective sound pattern to enhance the low frequency component.

23. The apparatus of claim 22, wherein the low frequency enhancer comprises a plurality of delays to delay the sum signal according to a plurality of delay times to generate a plurality of delayed signals, and a plurality of gain-controllers to gain-control the plurality of delayed signals according to corresponding ones of a plurality of gains to generate a plurality of reflective sound signals.

24. The apparatus of claim 22, wherein the externalization generator comprises:

first and second delays to delay the sum of the reflective sound signals according to first and second delay times to generate the first and second output signals, respectively;

a first delay and gain controller to delay and gain-control the sum of the reflective sound signals to be added to the delayed sum of the reflective sound signals delayed by the second delay time to generate a first delayed and gain-controlled signal as the second output signal;

a second delay and gain controller to delay and gain-control the sum of the reflective sound signals to be added to the delayed sum of the reflective sound signals delayed by the first delay time to generate a first delayed and gain-controlled signal as the first output signal;

a third delay and gain controller to delay and gain-control the delayed sum of the reflective sound signals delayed by the first delay time to be added to the sum of the reflective sound signals to generate a third delayed and gain-controlled signal as the sum of the reflective sound signals to be input to the first delay; and a fourth delay and gain controller to delay and gain-control the delayed sum of the reflective sound signals delayed by the second delay time to be added to the sum of the reflective sound signals to generate a fourth delayed and gain-controlled signal as the sum of the reflective sound signals to be input to the second delay.

25. The apparatus of claim 22, wherein the externalization generator comprises first and second delays to delay the sum of the reflective sound signals according to first and second delay times to provide the externalization to the input signals.

26. The apparatus of claim 25, further comprising:

first and second adders to add the first delayed sum of the first delay times to the first input signal and to add the second delayed sum of the reflective delay times to the first and second input signals, respectively.

27. The apparatus of claim 22, further comprising:

first and second adders to add the sum of the reflective sound signals to the first and second input signals to generate first and second sum signals, wherein the externalization generator comprises first and second delays to delay the first and second sum signals to generate the first and second output signals.

28. The apparatus of claim 22, wherein the externalization generator delays the sum of the reflective sound signals to be added to the input signals to generate the first and second output signals with the externalization.

29. The apparatus of claim 22, wherein the externalization generator delays a first combination of the first input signal and the sum of the reflected sound signals according to a first delay, and a second combination of the second input signal and the sum of the reflected sound signals according to a second delay to generate the first and second output signals with the externalization.

* * * * *